US007389601B1

(12) United States Patent
Guilmet

(10) Patent No.: US 7,389,601 B1
(45) Date of Patent: Jun. 24, 2008

(54) VEHICLE TOWING NOTIFICATION SIGN

(76) Inventor: Davis Guilmet, 21 Erie Ave., Newbury Port, MA (US) 01950

( * ) Notice: Subject to any disclaimer, the term of this patent is extended or adjusted under 35 U.S.C. 154(b) by 0 days.

(21) Appl. No.: 11/407,815

(22) Filed: Apr. 21, 2006

(51) Int. Cl.
*G09F 21/04* (2006.01)

(52) U.S. Cl. ..... 40/591; 40/600; 40/541; 40/592; 116/28 R

(58) Field of Classification Search ..... 40/591, 40/592, 600; 116/28 R
See application file for complete search history.

(56) References Cited

U.S. PATENT DOCUMENTS 3,208,173 A * 9/1965 Shank ..... 40/592
3,274,548 A * 9/1966 Brimsek ..... 340/473
3,633,299 A 1/1972 Westin
4,178,874 A * 12/1979 Berns et al. ..... 116/28 R
4,827,646 A 5/1989 Miller et al.
5,005,306 A * 4/1991 Kinstler ..... 362/486
5,031,347 A * 7/1991 Berg ..... 40/591
5,195,264 A * 3/1993 Johanson et al. ..... 40/591
5,339,551 A 8/1994 Elmer
D352,737 S 11/1994 Roberts
5,918,397 A * 7/1999 Elmer ..... 40/592
5,974,711 A 11/1999 Tipke
7,121,700 B1 * 10/2006 Scanlon ..... 362/493
2004/0074122 A1 * 4/2004 Goodwin et al. ..... 40/592

* cited by examiner

*Primary Examiner*—Cassandra Davis

(57) ABSTRACT

A vehicle sign assembly includes a pair of elongated sign boards that are attached to a tow vehicle pulling a towed vehicle. The signs protrude away from side doors of the tow vehicle so that they are visible. Each sign has three transparent sides. One side is abutted against the tow vehicle while second and third sides converge outwardly from the tow vehicle doors so that the signs can be seen from a front and a rear of the tow vehicle. The second and third sides include indicia printed thereon, signaling that a vehicle is being towed. Each sign includes a chamber formed between the sides thereof. A mechanism is included for illuminating the signs so that one sign can remain illuminated when another sign is non-illuminated. A mechanism is included for affixing the signs to the doors of the tow vehicle such that signs can be adjusted as needed.

18 Claims, 6 Drawing Sheets

VEHICLE TOWING NOTIFICATION SIGN

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to notification signs and, more particularly, to a vehicle towing notification sign for notifying bystanders of a vehicle's towing status.

2. Prior Art

Many working professionals, like carpenters, lawn care specialists and window installers, to name a few, make use of trailers that are attached to the rear of their vehicles in order to transport the necessary equipment and materials used in their line of work. Trailers are also often employed by general civilians for transporting large items, like furniture or appliances, between remote locations. Another common occurrence is where one vehicle is towing a second vehicle.

In some instances, the vehicle towing the trailer or the second vehicle may obscure other motorists' view of the trailer or second vehicle, which increases the chance that they might strike the trailer or vehicle during a sudden lane change procedure. Furthermore, a person turning or merging into the flow of traffic might not see a vehicle or trailer attached behind a towing vehicle, and accidentally strike the second vehicle or trailer as they attempt to enter the flow of traffic behind such a vehicle.

Obviously, having a means to notify other motorists of the presence of such a trailer or vehicle being pulled behind a towing vehicle is very beneficial. The use of vehicular mounted signs for certain display purposes is well known in the prior art. Typically, such signs are used for advertising the presence of a business or for indicating a service provided by the vehicle's operator. The signs use various mounting means, including brackets, magnetic strips and suction cups to be temporarily attached to the vehicle.

One major disadvantage of the above mentioned signs is that, due to their shape or preferred location, they are only visible from one line sight with respect to a bystander's orientation to the vehicle bearing the sign. Thus, the sign can only be viewed in full from either the side or the front and back of the vehicle. When considering such signs for warning purposes this is rather disadvantageous since the maximum level of visibility is most desirable, which would be a constant line of sight 360 degrees about the vehicle bearing the warning sign.

Accordingly, a need remains for a vehicle towing notification sign in order to overcome the above-noted shortcomings. The present invention satisfies such a need by providing a notification sign that is convenient and easy to use, provides a prominent display, and is safe to use in various applications. Instead of a trailer being overlooked by another motorist, such a sign draws their attention to the presence of a trailer positioned behind the towing vehicle. The improved warning sign advantageously prevents motorists from suddenly changing lanes or merging into a "hidden" trailer that is being towed. Thus, serious injury and vehicular damages are prevented, which in turn maintains both parties' insurance costs at a minimum. The highly visible design of the vehicle towing notification sign makes it visible from a great distance, allowing other motorists to adjust their driving habits and decisions accordingly.

BRIEF SUMMARY OF THE INVENTION

In view of the foregoing background, it is therefore an object of the present invention to provide a vehicle towing notification sign. These and other objects, features, and advantages of the invention are provided by a portable vehicle sign assembly for notifying bystanders of a vehicle's towing status.

The vehicle sign assembly includes a pair of elongated and coextensively shaped sign boards that are removably and directly attached to a leading tow vehicle to which a trailing towed vehicle is moored. Such a pair of sign boards are protruding laterally away from driver and passenger side doors of the leading tow vehicle such that the pair of sign boards are advantageously and effectively visible to a third-party vehicle directly aligned in parallel behind the trailing towed vehicle. Each of the pair of sign boards has three coextensively shaped and monolithically formed sides. Each of the sides of the pair of sign boards preferably includes planar interior and exterior surfaces contiguously extending along an entire length of the respective sign boards. Planar proximal and distal ends are monolithically formed with the interior and exterior surfaces respectively.

Each of the sides is equidistantly offset from a centrally registered longitudinal axis of the respective pair of sign boards. One of the sides of each of the pair of sign boards is abutted directly against the leading tow vehicle while second and third ones of the sides of each of the pair of sign boards converge outwardly and away from the driver and passenger side doors of the leading tow vehicle so that the pair of sign boards can conveniently be seen from a front and a rear of the leading tow vehicle. Each of the sides is formed from transparent material including indicia printed thereon for advantageously and effectively signaling the bystanders that a vehicle is being towed. Each of the pair of sign boards further includes a continuous and unitary chamber formed between the respective sides thereof.

A mechanism is included for independently illuminating the pair of sign boards such that one of the pair of sign boards can remain illuminated when another one of the pair of sign boards is non-illuminated. Such an independently illuminating mechanism may include at least one light emitting member that is directly connected to one of the interior surfaces of each of the pair of sign boards. An electrical coupling is disposed at one of the proximal and distal ends of the pair of sign boards. Such an electrical coupling is electrically mated to the at least one light emitting member.

A mechanism is included for independently and removably affixing the pair of sign boards directly to the driver and passenger doors of the leading tow vehicle such that each of the pair of sign boards can conveniently be adjustably positioned as needed during driving conditions. Such an independently and removably affixing mechanism preferably includes a first single and unitary strap that is directly conjoined to an exterior surface of one of the sides of a first one of the pair of sign boards. A second single and unitary strap is directly conjoined to an exterior surface of one of the sides of a second one of the pair of sign boards.

Each of the first and second unitary straps has a longitudinal length greater than the longitudinal lengths of the first and second sign boards. Each of the first and second unitary straps preferably includes a pair of coextensively shaped hooks that are directly coupled to proximal and distal end portions of the first and second unitary straps respectively. Such a pair of hooks is directly affixed to a window sill and a bottom edge of the driver and passenger doors such that the pair of sign boards are advantageously and effectively firmly secured along a vertical plane registered orthogonal to a ground surface.

In an alternate embodiment, the independently and removably affixing mechanism may include a magnetic strip affixed directly to one of the sides of each of the pair of sign boards.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
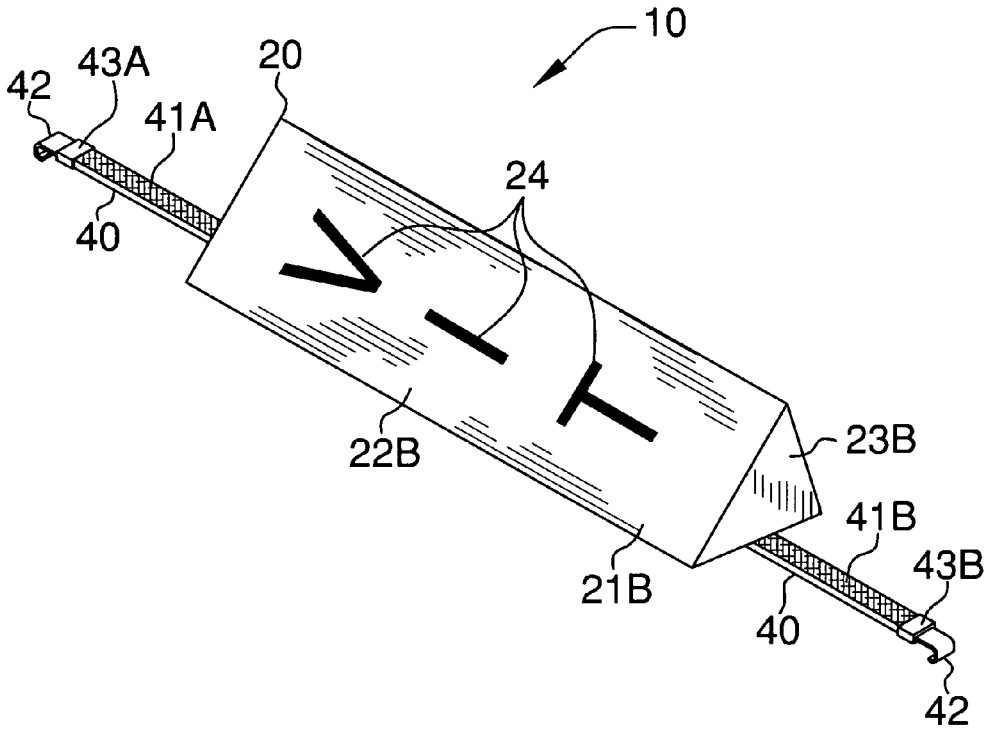
FIG. 1 is a perspective view showing a vehicle towing notification sign, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime numbers refer to alternate embodiments of such elements.

The assembly of this invention is referred to generally in FIGS. 1-7 by the reference numeral 10 and is intended to provide a vehicle towing notification sign. It should be understood that the assembly 10 may be used to display many different types of notification signs and should not be limited in use to only notifying third party vehicles of a towed vehicle.

Referring initially to FIGS. 1, 2, 3, 4, 5, 6 and 7, the assembly 10 includes a pair of elongated and coextensively shaped sign boards 20 that are removably and directly attached to a leading tow vehicle 11 to which a trailing towed vehicle 12 is moored. Of course, the trailing towed vehicle 12 may include either one of a covered trailer, an open trailer, a boat, a wagon or an automobile etc., as is obvious to a person of ordinary skill in the art. Furthermore, of course the sign boards 20 may be attached to the trailing towed vehicle 12 in the event that a suitable support surface is available, as is obvious to a person of ordinary skill in the art.

Figure 3:
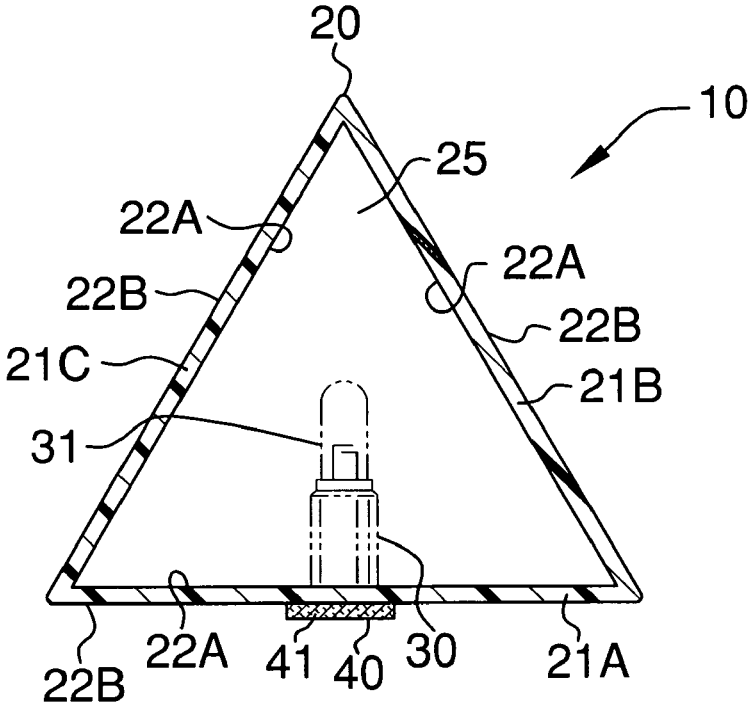
FIG. 3 is a cross-sectional view of the assembly shown in FIG. 2, taken along line 3-3, and showing the illuminating mechanism positioned within the chamber.

Such a pair of sign boards 20 protrudes laterally away from driver 13A and passenger 13B side doors 13 of the leading tow vehicle 11, which is essential such that the pair of sign boards 20 are advantageously and effectively visible to a third-party vehicle directly aligned in parallel behind the trailing towed vehicle 12. Of course, the sign boards 20 are also visible to a driver located to the side of or in front of the leading tow vehicle 11, as is obvious to a person of ordinary skill in the art. Each of the pair of sign boards 20 has three coextensively shaped and monolithically formed sides 21. Each of the sides 21 of the pair of sign boards 20 includes planar interior 22A and exterior 22B surfaces contiguously extending along an entire length of the respective sign boards 20, as is best shown in FIGS. 3 and 5. Planar proximal 23A and distal 23B ends are monolithically formed with the interior 22A and exterior 22B surfaces respectively, as is illustrated in FIG. 4.

Referring to FIGS. 1, 2, 3, 4, 5 and 7, each of the sides 21 is equidistantly offset from a centrally registered longitudinal axis of the respective pair of sign boards 20. One of the sides 21A of each of the pair of sign boards 20 is abutted directly against, without the use of intervening elements, the leading tow vehicle 11 while second 21B and third 21C ones of the sides 21 of each of the pair of sign boards 20 converge outwardly and away from the driver 13A and passenger 13B side doors of the leading tow vehicle 11, which is crucial so that the pair of sign boards 20 can conveniently be seen from a front and a rear of the leading tow vehicle 11.

Each of the sides 21 is formed from transparent material including indicia 24 printed thereon that is important for advantageously and effectively signaling the bystanders that a vehicle 12 is being towed. Of course, the sign boards 20 may include a variety of surface indicia for other display purposes, like advertising, as is obvious to a person of ordinary skill in the art. Each of the pair of sign boards 20 further includes a continuous and unitary chamber 25 formed between the respective sides 21 thereof.

Figure 4:
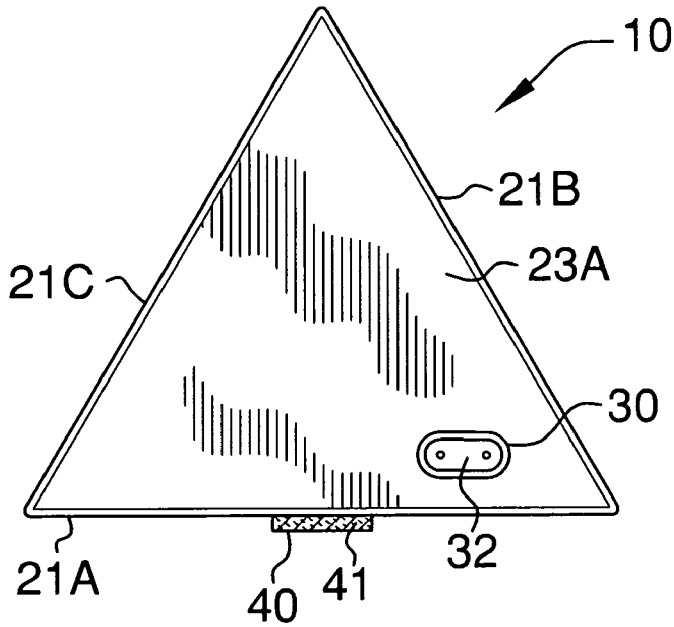
FIG. 4 is top plan view of the assembly shown in FIG. 2, viewed along line 4-4.
Figure 5:
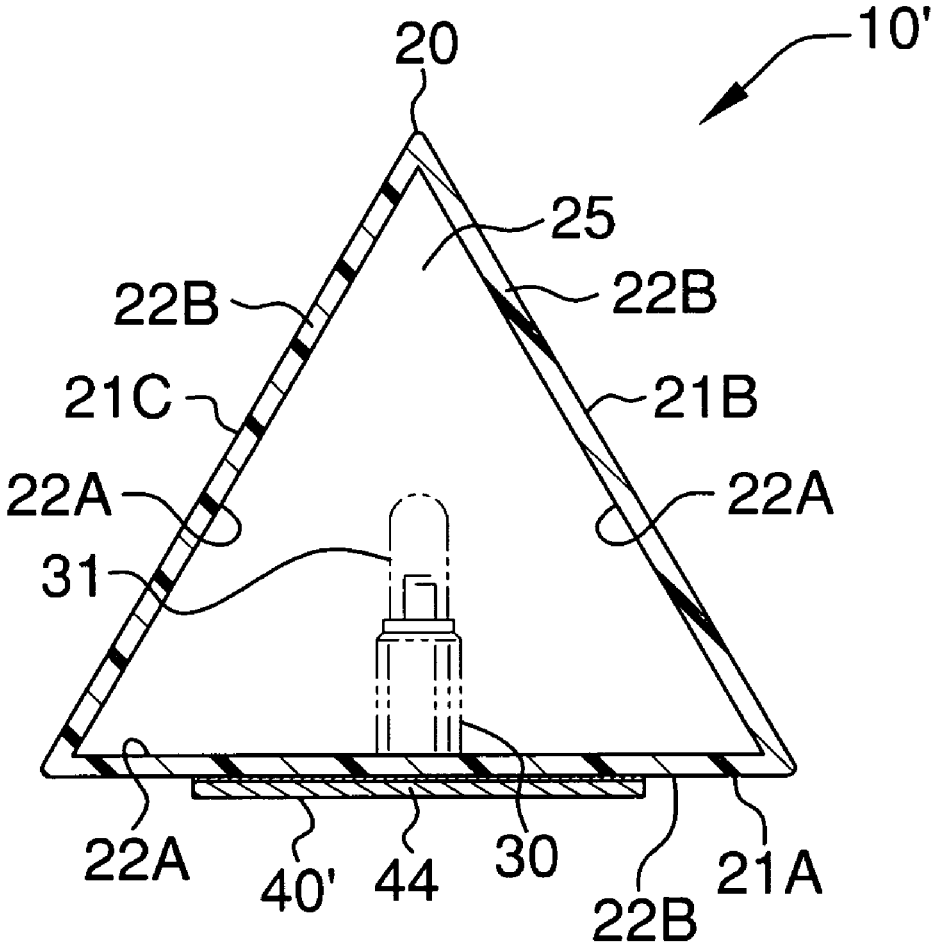
FIG. 5 is cross-sectional view showing an alternate embodiment of the sign assembly shown in FIG. 3, in accordance with the present invention.

Referring to FIGS. 3, 4 and 5, a mechanism 30 is included for independently illuminating the pair of sign boards 20, which is vital such that one of the pair of sign boards 20 can remain illuminated when another one of the pair of sign boards 20 is non-illuminated. Of course, the sign boards 20 can be simultaneously illuminated if the user so desires, as is obvious to a person of ordinary skill in the art. Such an independently illuminating mechanism 30 includes at least one light emitting member 31 that is directly connected, without the use of intervening elements, to one of the interior surfaces 22A of each of the pair of sign boards 20.

An electrical coupling 32 is disposed at one of the proximal 23A and distal ends 23B of the pair of sign boards 20, as is best shown in FIG. 4. Such an electrical coupling 32 is electrically mated to the at least one light emitting member 31. Of course, more than one light emitting member 31 may be used, and the necessary elements may be added for causing multiple light emitting members 31 to flash simultaneously or in a predetermined order for further increasing the visibility of the sign boards 20, as is obvious to a person of ordinary skill in the art.

Referring to FIGS. 1, 2, 3, 4, 6 and 7, a mechanism 40 is included for independently and removably affixing the pair of sign boards 20 directly to the driver 13A and passenger 13B doors of the leading tow vehicle 11 such that each of the pair of sign boards 20 can conveniently be adjustably positioned as needed during driving conditions. Of course, the sign boards 20 may be attached to the trailing towed vehicle 12 in the event that a suitable support surface is available, as is obvious to a person of ordinary skill in the art. Such an independently and removably affixing mechanism 40 includes a first single and unitary strap 41A that is directly conjoined, without the use of intervening elements, to an exterior surface 22B of one of the sides 21A of a first one 20A of the pair of sign boards 20. A second single and unitary strap 41B is directly conjoined, without the use of intervening elements, to an exterior surface 22B of one 21A of the sides 21 of a second one 20B of the pair of sign boards 20.

Figure 2:
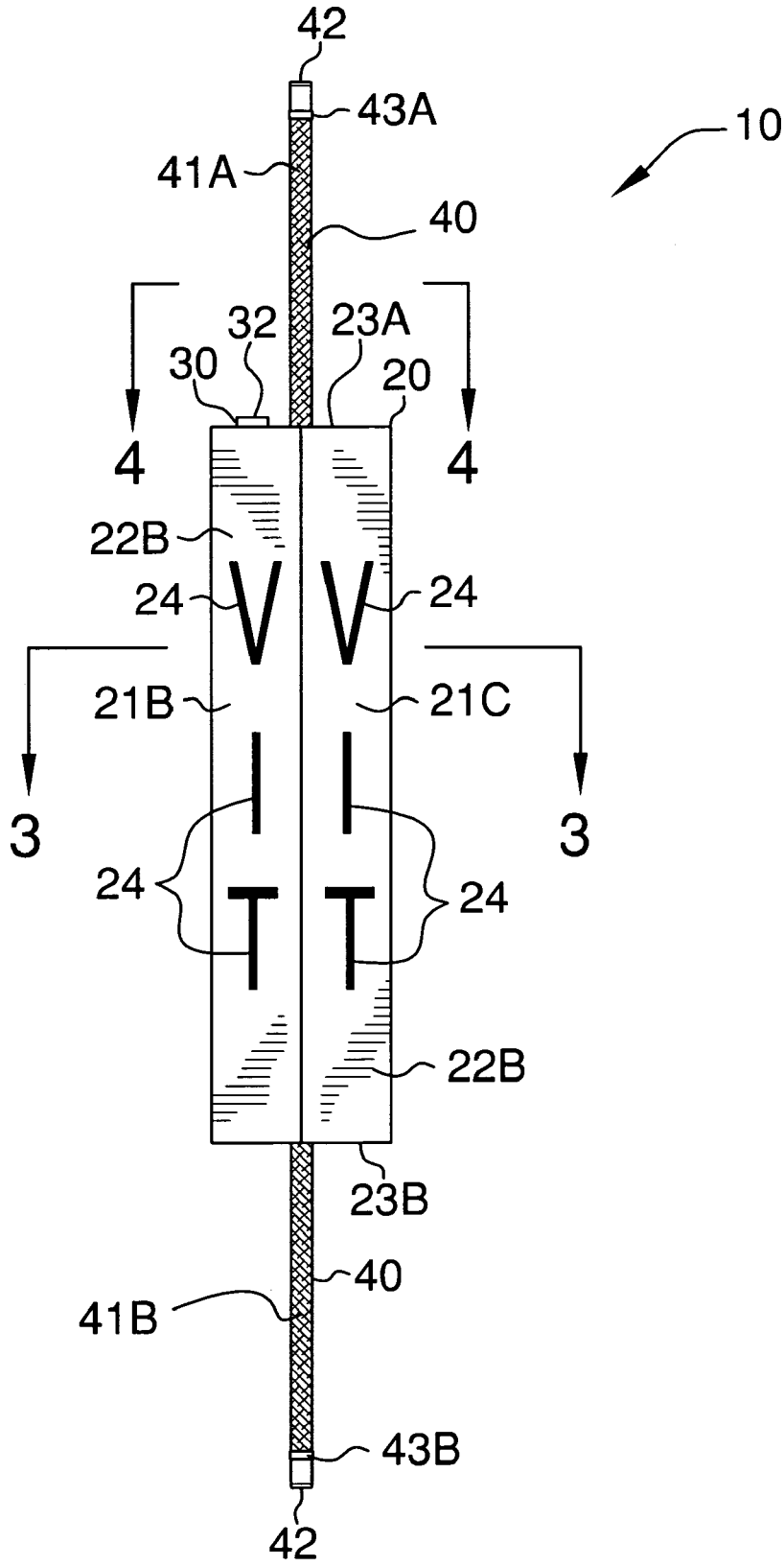
FIG. 2 is a front-elevational view of the sign assembly shown in FIG. 1.
Figure 6:
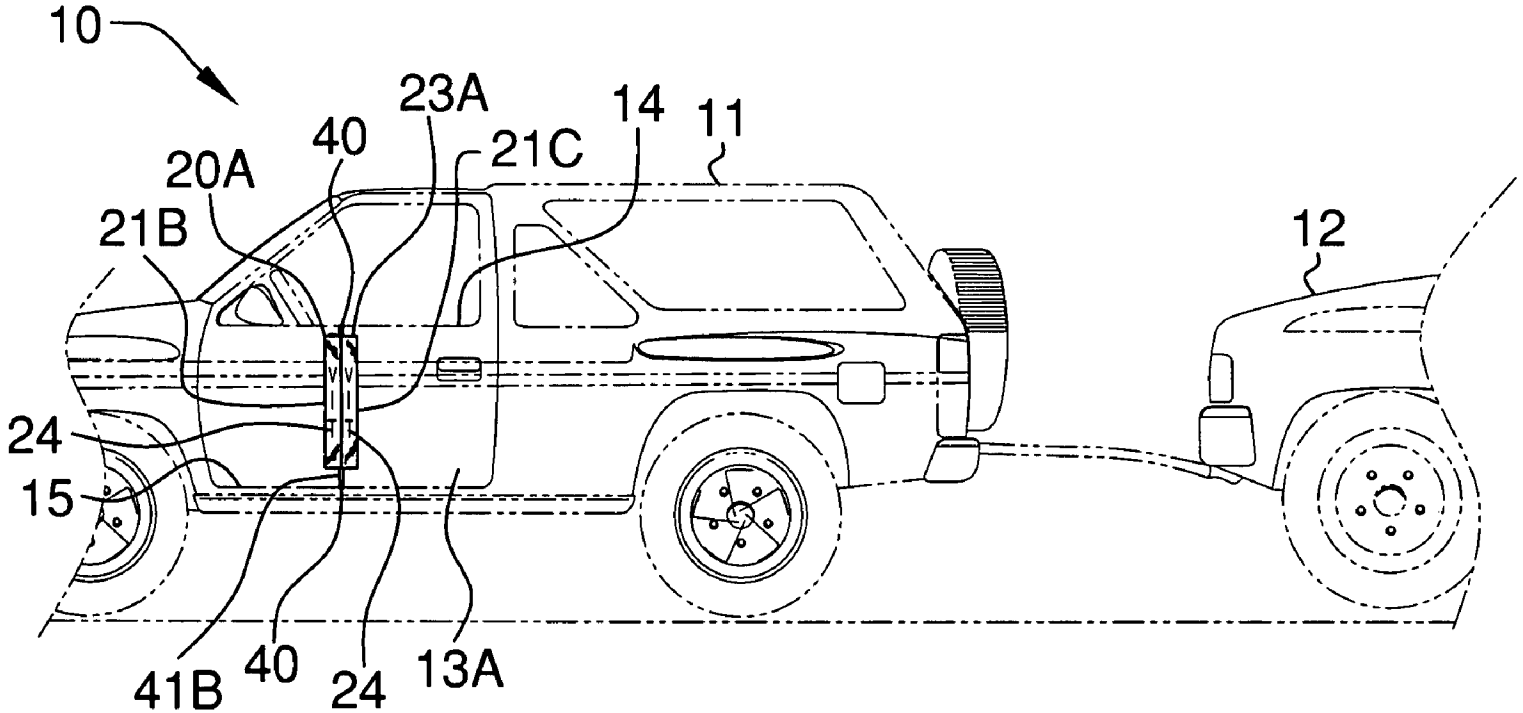
FIG. 6 is a side-elevational view showing the vehicle towing notification sign during operating conditions, in accordance with the present invention.
Figure 7:
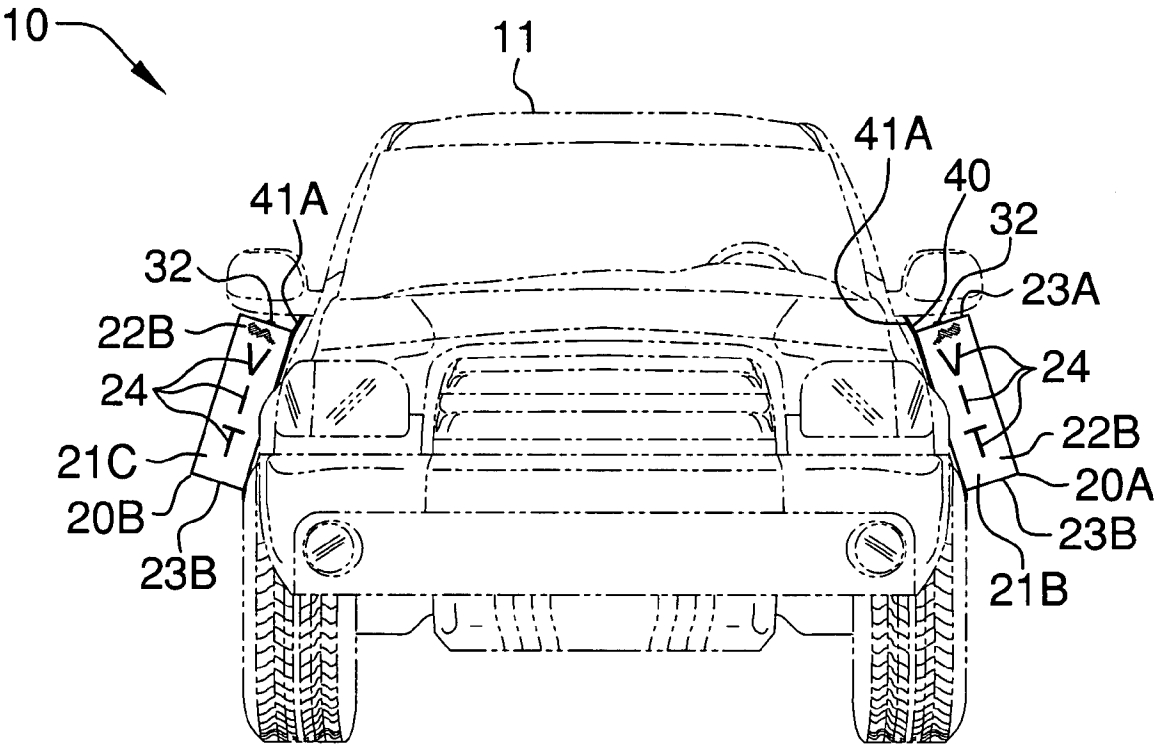
FIG. 7 is a front-elevational view of the assembly shown in FIG. 6, showing one sign board attached to either side of the towing vehicle.

Referring to FIGS. 1 and 2, each of the first 41A and second 41B unitary straps has a longitudinal length greater than the longitudinal lengths of the first 20A and second 20B sign boards. Each of the first 41A and second 41B unitary straps includes a pair of coextensively shaped hooks 42 that are directly coupled, without the use of intervening elements, to proximal 43A and distal 43B end portions of the first 41A and second 41B unitary straps respectively. Such a pair of hooks 42 is directly affixed, without the use of intervening elements, to a window sill 14 and a bottom edge 15 of the driver 13A and passenger 13B doors such that the pair of sign boards 20 are advantageously and effectively firmly secured along a vertical plane registered orthogonal to a ground surface, as is best shown in FIG. 6.

Referring to FIG. 5, in an alternate embodiment 10', the independently and removably affixing mechanism 40' includes a magnetic strip 44 affixed directly, without the use of intervening elements, to one of the sides 21A of each of the pair of sign boards 20. Such a magnetic strip 44 advantageously minimizes any damage that may be inflicted upon a painted or otherwise finished surface of the leading tow vehicle's doors 13. The magnetic strip 44 conveniently allows for quick and easy adjustment of the sign assembly 10 such that a user can reposition the sign boards 20 for optimal visibility. Such a magnetic strip 44 also allows advantageously and effectively allows a user to quickly and easily transfer the sign assembly 10 from one leading tow vehicle 11 to another, remotely located, leading tow vehicle 11. Of course, the assembly 10 may employ other suitable affixing mechanisms, like suction cups, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A portable vehicle sign assembly for notifying bystanders of a vehicle's towing status, said vehicle sign assembly comprising:

a pair of elongated and coextensively shaped sign boards removably and directly attached to a leading tow vehicle to which a trailing towed vehicle is moored, said pair of sign boards being protruding laterally away from driver and passenger side doors of the leading tow vehicle such that said pair of sign boards are visible to a third-party vehicle directly aligned in parallel behind the trailing towed vehicle, each of said pair of sign boards having three coextensively shaped and monolithically formed sides, each of said sides being equidistantly offset from a centrally registered longitudinal axis of said respective pair of sign boards, each of said sides being formed from transparent material including indicia printed thereon for signaling the bystanders that a vehicle is being towed;

means for independently illuminating said pair of sign boards such that one of said pair of sign boards can remain illuminated when another one of said pair of sign boards is non-illuminated; and means for independently and removably affixing said pair of sign boards directly to the driver and passenger doors of the leading tow vehicle such that each of said pair of sign boards can be adjustably positioned as needed during driving conditions.

2. The assembly of claim 1, wherein each of said sides of said pair of sign boards comprises:

planar interior and exterior surfaces contiguously extending along an entire length of said respective sign boards; and planar proximal and distal ends monolithically formed with said interior and exterior surfaces respectively.

3. The assembly of claim 1, wherein said independently illuminating means comprises:

at least one light emitting member directly connected to one of said interior surfaces of each of said pair of sign boards; and an electrical coupling disposed at one of said proximal and distal ends of said pair of sign boards, said electrical coupling being electrically mated to said at least one light emitting member.

4. The assembly of claim 1, wherein said independently and removably affixing means comprises:

a first single and unitary strap directly conjoined to an exterior surface of one of said sides of a first one of said pair of sign boards; and a second single and unitary strap directly conjoined to an exterior surface of one of said sides of a second one of said pair of sign boards;

each of said first and second unitary straps having a longitudinal length greater than the longitudinal lengths of said first and second sign boards.

5. The assembly of claim 4, wherein each of said first and second unitary straps comprises:

a pair of coextensively shaped hooks directly coupled to proximal and distal end portions of said first and second unitary straps respectively, said pair of hooks being directly affixed to a window sill and a bottom edge of the driver and passenger doors such that said pair of sign boards are firmly secured along a vertical plane registered orthogonal to a ground surface.

6. The assembly of claim 1, wherein said independently and removably affixing means comprises:

a magnetic strip affixed directly to one of said sides of each of said pair of sign boards.

7. A portable vehicle sign assembly for notifying bystanders of a vehicle's towing status, said vehicle sign assembly comprising:

a pair of elongated and coextensively shaped sign boards removably and directly attached to a leading tow vehicle to which a trailing towed vehicle is moored, said pair of sign boards being protruding laterally away from driver and passenger side doors of the leading tow vehicle such that said pair of sign boards are visible to a third-party vehicle directly aligned in parallel behind the trailing towed vehicle, each of said pair of sign boards having three coextensively shaped and monolithically formed sides, each of said sides being equidistantly offset from a centrally registered longitudinal axis of said respective pair of sign boards, each of said sides being formed from transparent material including indicia printed thereon for signaling the bystanders that a vehicle is being towed, wherein each of said pair of sign boards comprises a continuous and unitary chamber formed between said respective sides thereof;

means for independently illuminating said pair of sign boards such that one of said pair of sign boards can remain illuminated when another one of said pair of sign boards is non-illuminated; and means for independently and removably affixing said pair of sign boards directly to the driver and passenger doors of the leading tow vehicle such that each of said pair of sign boards can be adjustably positioned as needed during driving conditions.

8. The assembly of claim 7, wherein each of said sides of said pair of sign boards comprises:

planar interior and exterior surfaces contiguously extending along an entire length of said respective sign boards; and planar proximal and distal ends monolithically formed with said interior and exterior surfaces respectively.

9. The assembly of claim 7, wherein said independently illuminating means comprises:

at least one light emitting member directly connected to one of said interior surfaces of each of said pair of sign boards; and an electrical coupling disposed at one of said proximal and distal ends of said pair of sign boards, said electrical coupling being electrically mated to said at least one light emitting member.

10. The assembly of claim 7, wherein said independently and removably affixing means comprises:

a first single and unitary strap directly conjoined to an exterior surface of one of said sides of a first one of said pair of sign boards; and a second single and unitary strap directly conjoined to an exterior surface of one of said sides of a second one of said pair of sign boards;

each of said first and second unitary straps having a longitudinal length greater than the longitudinal lengths of said first and second sign boards.

11. The assembly of claim 10, wherein each of said first and second unitary straps comprises:

a pair of coextensively shaped hooks directly coupled to proximal and distal end portions of said first and second unitary straps respectively, said pair of hooks being directly affixed to a window sill and a bottom edge of the driver and passenger doors such that said pair of sign boards are firmly secured along a vertical plane registered orthogonal to a ground surface.

12. The assembly of claim 7, wherein said independently and removably affixing means comprises:

a magnetic strip affixed directly to one of said sides of each of said pair of sign boards.

13. A portable vehicle sign assembly for notifying bystanders of a vehicle's towing status, said vehicle sign assembly comprising:

a pair of elongated and coextensively shaped sign boards removably and directly attached to a leading tow vehicle to which a trailing towed vehicle is moored, said pair of sign boards being protruding laterally away from driver and passenger side doors of the leading tow vehicle such that said pair of sign boards are visible to a third-party vehicle directly aligned in parallel behind the trailing towed vehicle, each of said pair of sign boards having three coextensively shaped and monolithically formed sides, each of said sides being equidistantly offset from a centrally registered longitudinal axis of said respective pair of sign boards, wherein one of said sides of each of said pair of sign boards is abutted directly against the leading tow vehicle while second and third ones of said sides of each of said pair of sign boards converge outwardly and away from the driver and passenger side doors of the leading tow vehicle so that said pair of sign boards can be seen from a front and a rear of the leading tow vehicle, each of said sides being formed from transparent material including indicia printed thereon for signaling the bystanders that a vehicle is being towed, wherein each of said pair of sign boards comprises a continuous and unitary chamber formed between said respective sides thereof;

means for independently illuminating said pair of sign boards such that one of said pair of sign boards can remain illuminated when another one of said pair of sign boards is non-illuminated; and means for independently and removably affixing said pair of sign boards directly to the driver and passenger doors of the leading tow vehicle such that each of said pair of sign boards can be adjustably positioned as needed during driving conditions.

14. The assembly of claim 13, wherein each of said sides of said pair of sign boards comprises:

planar interior and exterior surfaces contiguously extending along an entire length of said respective sign boards; and planar proximal and distal ends monolithically formed with said interior and exterior surfaces respectively.

15. The assembly of claim 13, wherein said independently illuminating means comprises:

at least one light emitting member directly connected to one of said interior surfaces of each of said pair of sign boards; and an electrical coupling disposed at one of said proximal and distal ends of said pair of sign boards, said electrical coupling being electrically mated to said at least one light emitting member.

16. The assembly of claim 13, wherein said independently and removably affixing means comprises:

a first single and unitary strap directly conjoined to an exterior surface of one of said sides of a first one of said pair of sign boards; and a second single and unitary strap directly conjoined to an exterior surface of one of said sides of a second one of said pair of sign boards;

each of said first and second unitary straps having a longitudinal length greater than the longitudinal lengths of said first and second sign boards.

17. The assembly of claim 16, wherein each of said first and second unitary straps comprises:

a pair of coextensively shaped hooks directly coupled to proximal and distal end portions of said first and second unitary straps respectively, said pair of hooks being directly affixed to a window sill and a bottom edge of the driver and passenger doors such that said pair of sign boards are firmly secured along a vertical plane registered orthogonal to a ground surface.

18. The assembly of claim 13, wherein said independently and removably affixing means comprises:

a magnetic strip affixed directly to one of said sides of each of said pair of sign boards.

* * * * *